United States Patent [19]

Austin et al.

[11] 4,070,725

[45] Jan. 31, 1978

[54] COMBINED PUMP AND SIPHON

[75] Inventors: Forrest L. Austin, Brooklyn Center; Richard T. Cornelius, Minneapolis, both of Minn.

[73] Assignee: Cornelius Engineering Center, Inc., New Hope, Minn.

[22] Filed: Nov. 7, 1975

[21] Appl. No.: 629,757

[51] Int. Cl.[2] .....F04B 41/100; F04B 43/08; F04B 43/12; F04B 45/06; F04F 10/00

[52] U.S. Cl......417/236; 417/477; 222/192; 222/416

[58] Field of Search .....416/236; 417/236, 476, 477; 222/204, 214, 192, 416

[56] References Cited

U.S. PATENT DOCUMENTS

| | | | |
|---|---|---|---|
| 1,765,360 | 6/1930 | Baumann | 417/477 |
| 2,314,281 | 3/1943 | Knott | 417/477 |
| 2,018,999 | 10/1935 | De Bakey et al | 417/477 |
| 3,384,132 | 5/1968 | Lisciani | 222/204 |
| 1,703,361 | 2/1929 | Pohl | 417/477 |
| 2,899,905 | 8/1959 | Becher | 417/477 |
| 3,175,507 | 3/1965 | Rydberg | 417/477 |
| 3,927,955 | 12/1975 | Spinosa | 417/477 |
| 2,899,906 | 8/1959 | Becher et al | 417/477 |

*Primary Examiner*—Carton R. Croyle
*Assistant Examiner*—Thomas I. Ross
*Attorney, Agent or Firm*—Hill, Gross, Simpson, Van Santen, Steadman, Chiara & Simpson

[57] ABSTRACT

A portable pump of the peristaltic type has rollers that are driven along a length of resilient tubing to create the pumping action. The rollers are retractable to permit the pump to operate as a siphon, and also to prevent the forming of any set in the tube. Means are provided that prevents jumping of a roller and thus avoiding attendant noise and lessening of efficiency. The pump has a thermally insulative pistol grip spaced from the main portion of the housing to enable the pump to handle hot fluids while held by hand. The pump has an optional spray nozzle and spray nozzle extension for connection to the discharge of the pump by which the device is converted into a sprayer. The device of the invention can be driven by hand or by a motor.

10 Claims, 6 Drawing Figures

COMBINED PUMP AND SIPHON

BACKGROUND OF THE INVENTION

1. Field of the Invention:

This invention pertains to a portable pump of the peristaltic type which is selectably a combined pump-siphon.

2. Prior Art:

Pumps of the peristaltic type include a resilient tube which is progressively compressed by a number of rollers. The material of which a particular resilient tube is made is such that if such prior device were permitted to stand without use, eventually the tube would take a permanent set, leaving a dent that would impare subsequent usage. Further, prior hand-held pumps could not be used to transfer a hot liquid, such as oil, because at least one of the hands of the user would become burned. Further, known prior pumps have not been particularly versatile as to the uses to which they could be put, thus necessitating the procurement in usage of various devices to accomplish various purposes.

SUMMARY OF THE INVENTION

The present invention is directed to a hand-held pump of the peristaltic type capable of handling hot fluids and having retractable rollers for preventing dent formation in the flexible tube, thereby converting the device into a siphon having a pump for priming. Means are provided for preventing loose rollers from jumping and for converting the pump into a sprayer.

Accordingly, it is an object of the present invention to provide a pump of the peristaltic type which is resistant to dent formation in its flexible tube.

A further object of the present invention is to provide means by which lose rollers in a peristaltic pump are prevented from jumping at the end of its pumping stroke or movement.

Another object of the present invention is to provide a hand-held pump capable of handling hot liquids.

A further object of the present invention is to provide a pump that can be set to function as a siphon.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

AS SHOWN ON THE DRAWINGS

Figure 1:
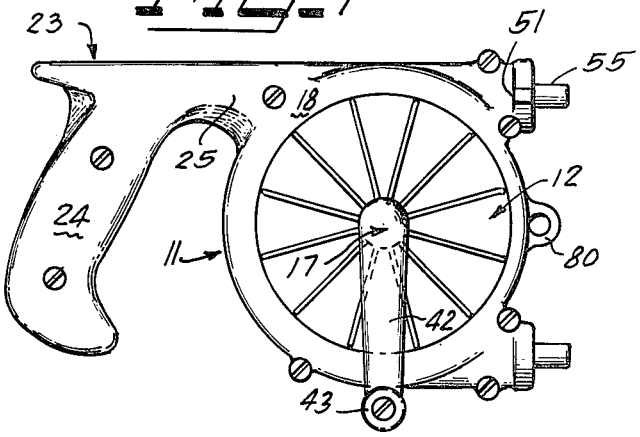
FIG. 1 is a side elevational view of a pump constructed in accordance with the principles of the present invention.
Figure 3:
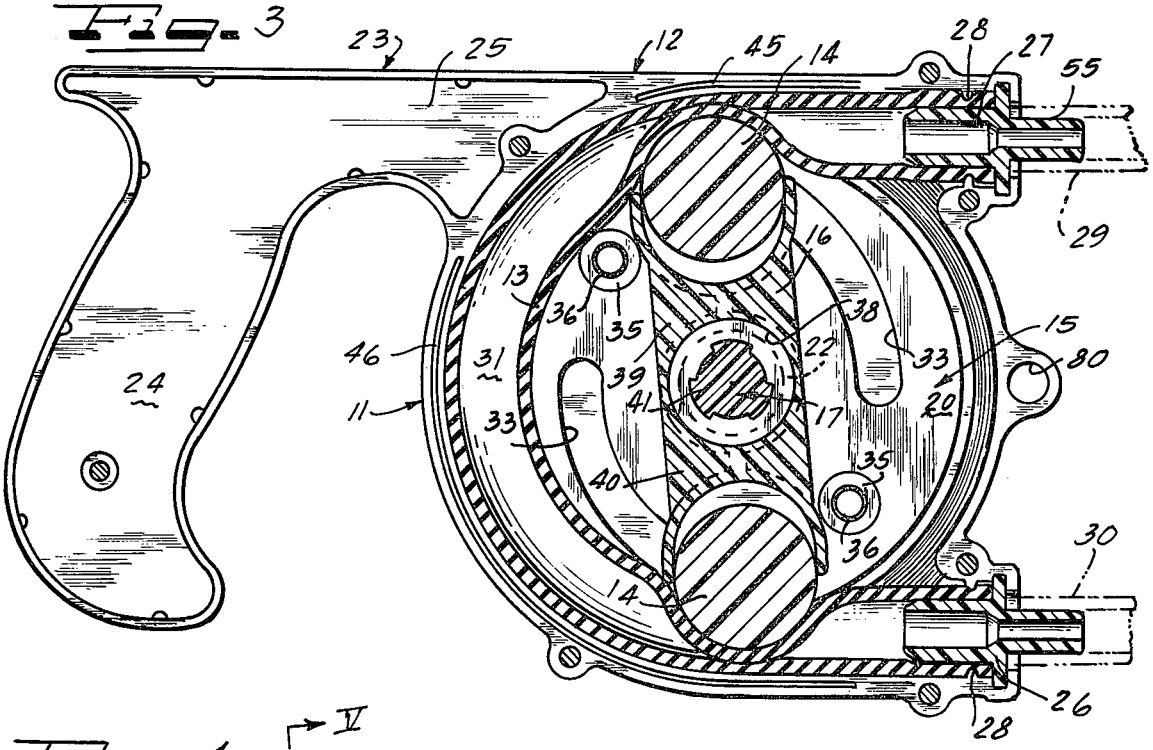
FIG. 3 is an enlarged cross-sectional view taken along line III—III of FIG. 2.

The principles of the present invention are particularly useful when embodied in a pump as shown in FIG. 1, generally indicated by the numeral 11. As best seen in FIG. 3, the pump 11 includes a housing or housing assembly 12 within which there is disposed a resilient U-shaped tube 13, made, for example, of neoprene. A number of rollers 14 are carried by support means 15 and are also controlled by a guide member 16. The support means 15 are drivably connected to means 17 by which the same is rotated.

The housing 12 includes a pair of complemental molded sections 18, 19 that contain the components 13–16 and which receives the rotating means 17. The support means 15 includes a carrier also made from a pair of complemental generally flat sections 20, which support the rollers 14 and the guide member 16. The complemental sections 20, 20 are of the same configuration and each includes a bearing portion 21 formed as a recess which receives a bearing portion 22 which is an annular ring molded onto the inside face of the housing sections 18, 19.

Formed integrally with the housing 12 is a handle 23 which includes a gripping portion 24 which is spaced from the main portion of the housing 12 by an extension 25. The nature of the material of the handle 23, its hollow configuration, the extension 25, and the spacing provided by the extension 25 protect the hand from becoming burned when the pump 11 is used to transfer hot liquids.

The resilient tube 13 had an inlet fitting 26 at one end, and an outlet fitting 27 at the other end, pressed therein, each fitting 26, 27 being surrounded by a clamping ridge 28 by which the ends of the tube 13 are securely held. The fittings 26, 27 are adapted to receive various lines or other fittings described below, and including plain tubing 29, 30 shown diagramatically in FIG. 3. Between the inlet 26 and the outlet 27, the tube 13 has an intermediate arcuate portion 31 that extends for 180° and communicates with straight portions that lead to the fittings 26, 27. Throughout the length of the tubing between the fittings, the housing 12 engages the periphery of the tube 13 remotely from the rotational axis of the support means 15, the arcuate portion 31 being concentric with such axis. The fittings 26, 27 are both directed in the same direction from the main portion of the housing 12, such direction being opposite to the projection of the handle 23.

Figure 4:
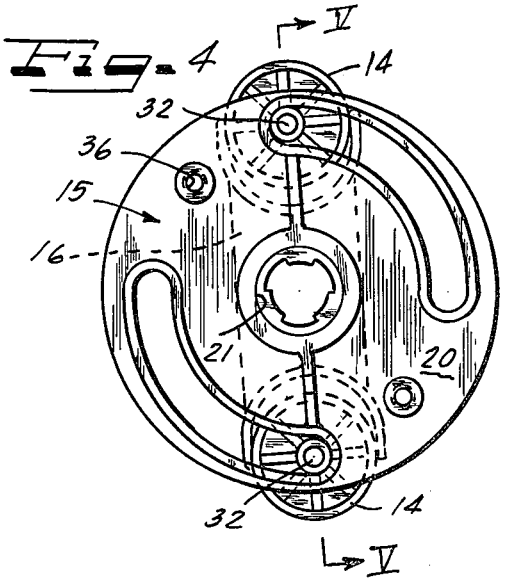
FIG. 4 is an elevational view in reduced scale of certain structure sectioned in FIG. 3.
Figure 5:
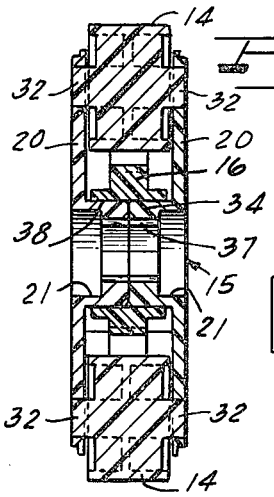
FIG. 5 is a cross-sectional view taken along line V—V of FIG. 4.

An important aspect of the present invention is that the rollers 14 are not only driven orbitally when moved in a clockwise direction as shown in FIG. 3 to engage and collapse the tube 13, but the rollers 14 are also so supported that they can shift radially inwardly so as to disengage or substantially disengage the tube 13. As best seen in FIGS. 4 and 5, the rollers 14, 14 are disposed between the carrier sections 20, 21, and each has a journal 32 by which the same is enabled to rotate on the support means 15 about axes which are parallel to the central axis. As shown in FIGS. 4 and 5, portions of the rollers 14 may be omitted to minimize the use of plastic material. The rollers 14 are loosely carried on the support means or carrier 15 to enable radial shifting thereof, and to that end, the support means includes means 33 on the support means 15 for enabling such radial shifting. In this embodiment, the radial shifting means comprises a bearing slot 33 for each of the journals 32 and disposed in the carrier sections 20, 20. Each slot is not only elongated and is arcuate, but constitutes an arc-portion of a spiral in that the distance between the arcuate center line of such slot and the central axis is a changing radius. Although the rollers 14 can roll or slide along the length of each of the slots 33, it is the curved end of the slot that constitutes the portion that functions as a bearing on which the journals rotate after the rollers have been shifted to either their outermost position as drawn or their radially innermost position.

As best seen in FIGS. 4 and 5 the generally flat complemental sections 20, 20 have a central hub portion which together with that of the other section 20 jointly provides a central hub 34 which holds the generally flat sections 20, 20 in spaced position. This structure is locked together in that each of the sections 20, 20 has an additional boss 35, between the ends of adjacent slots, and this pair of bosses 35 has an axial extent corresponding to that of the hub portions. The bosses 35 are centrally apertured and a tubular rivet 36 holds the carrier sections in the position illustrated. The hub 34 has a non-circular hole 37 therethrough which is receptive of the rotating means 17 from either side of the housing 12, thus accommodating the preferences of a left-handed or right-handed user.

The upper roller 14, during a pumping stroke, is trapped between the upper end of the forward groove 33 and the compressed tube 13, and when it progressively engages the upper straight portion of the tube 13, the extent to which the roller 14 is pinched or held gradually decreases to a point where there is a tendency for it to pop out suddenly along the groove 33 at a rate faster than the support carrier 15 is being rotated. The presence of the guide member 16 prevents any such jumping movement. For that purpose, the guide member 16 is centrally apertured as at 38 to provide a bearing surface which is rockably supported on the outside of the hub 34 for movement through an angle which is less than 180°. As shown in FIG. 3, the bosses 35, 35 limit this movement, and this angle is also limited by the angular extent of the spirally arcuate slots 33, 33. The guide member 16 has a pair of radial arms 39, 40. If the construction be modified to include more rollers, then the uniform angular spacing of the radial arms is maintained. Each of the arms 39, 40 is bifurcated at its outer or distal ends and has a spacing such that it receives the roller 14 near its diameter. As seen from the several views, portions of the guide member 16 are cut away so as not to use unnecessary plastic material.

The means 17 for rotating the support carrier 15 includes a drive shaft or portion 41 to which a crank 42 carrying a handle 43 is secured. A large washer 44 (FIG. 2) is placed over the aperture in the housing section 19 and a screw (not shown) extends through the washer 44 into the end of the drive shaft portion 41. Additional screws are provided as shown to hold the housing sections together, preferably of the self-tapping type. The housing sections 18, 19 as best seen in FIG. 3 have complemental ridges and valleys 45, 46 which interfit and hold the plastic material in place between the housing screws.

In operation, the pump 11 is used to transfer a liquid from a source to some other article. For example, the inlet hose 30 can be inserted into a hot engine through the dip-stick opening to drain the crankcase of an automobile engine, boat engine, lawn mower or the like. Also, it could be inserted into a source of fuel such as the user's car gasoline tank in order to transfer fuel therefrom to a lawn mower, a snowmobile, a snow blower or the like. In this type of usage, the pump 11 serves as a metering device. Although not precise, about 100 revolutions of the rotating means 17 transfers one gallon of fuel. The enumeration of usages is not comprehensive, but illustrates that the device can be used with hot or cold liquids and the liquids can be water, fuel, oil, and undoubtedly others. The pump 11 is self-priming and if the level of liquid in the source is higher than the level is to which liquid is being transferred, a reverse movement of the rotating means for 90° effects radial shifting of the rollers 14 in an inward direction to the other end of the slots 33. Under this condition, no further cranking is necessary because the liquid will flow utilizing the principles of a siphon. To stop the flow, the crank is turned in a forward direction for 90° and the condition or relative position of the parts will be restored as shown in FIG. 3.

If desired, the pump 11 may be cleaned after usage, but when it is to be taken out of usage and stored, the crank is rotated one-fourth turn in the reverse direction to retract the rollers 14 from tube 13 so that the tube 13 will not take a set at the roller in the form of a dent.

Figure 6:
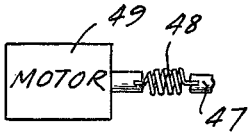
FIG. 6 is a schematic fragmentary view of an alternate means for operating the pump.

FIG. 6 schematically illustrates an alternate form of means for rotating the support carrier 15. In this embodiment, a drive shaft 47, corresponding in cross-section to the drive shaft portion 41, is connected through a torsion spring 48 to a motor 49. There is relatively little resistance to rotation of the support carrier 15 in a reverse direction, and there is considerably more resistance in the forward or pumping direction because of the reaction obtained by the tube 13. Thus when the motor 49 is started, there is a drag on the drive shaft 47 which causes the motor 49 to turn at least 90° to store energy in the torsion spring 48 before the shaft 47 begins to rotate. When the motor 49 is stopped, and preferably braked, the torsion spring 48 will unwind, thereby rotating the shaft 47 at least one-fourth turn in the reverse direction. This places the rollers 14 in position either for siphoning or for extended storage.

Figure 2:
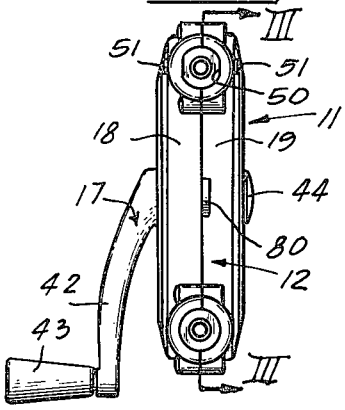
FIG. 2 is a front elevational view thereof.

In the uses thus far described, the liquid had been discharged from the outlet fitting 27 through the hose 29. As shown in FIG. 2, an opening 50 in the housing 12 is non-circular, and adjacent thereto, there are a pair of rearwardly facing shoulders 51, 51. By means of these features, the pump 11 can be attached to other structures.

As shown in FIGS. 1–3, a storage eyelet 80 is a part of the housing 12 and enables the pump 11 to be hung on a nail or hook.

Although various minor modifications might be suggested by those versed in the art, it should be understood that we wish to embody within the scope of the patent warranted hereon, all such embodiments as reasonably and properly come within the scope of our contribution to the art.

What we claim as our invention is:

1. A pump comprising:

a. a housing;

b. a resilient tube disposed within said housing and having an inlet and an outlet, said tube having a portion intermediate its ends extending in an arcuate manner;

c. a plurality of rollers in said housing; and d. support means within said housing supporting said rollers, said support means being rotatable about the axis of said arcuate portion for orbiting said rollers, said support means including means to shift said rollers radially to engage and collapse said tube and to shift said rollers radially to substantially disengage said tube, said support means comprising:

1. a pair of axially spaced generally flat sections joined together by a central drive hub, and rotatably supported by said housing concentric with the arcuate portion of said tube;

2. said sections having spirally arcuate bearing slots receiving journals on said rollers; and 3. a guide member rockable about said axis and carried on said hub and having a plurality of equally spaced arms extending radially therefrom, the distal end of each of said arms being bifurcated and guidingly embracing one of said rollers near its diameter.

2. A combined pump and siphon, comprising:

a. a housing;

b. a resilient tube within said housing and having an inlet and an outlet, said tube having a portion intermediate its ends and extending in an arcuate manner;

c. a plurality of rollers in said housing; and d. support means within said housing supporting said rollers, said support means being rotatable about the axis of said arcuate portion for orbiting said rollers, said support means including means enabling said rollers to automatically shift radially to engage and collapse said tubes in response to rotation of said support means in one direction, and to automatically shift said rollers radially to substantially disengage said tube in response to rotation of said support means in the other direction, said support means comprising:

1. a pair of separate axially spaced generally flat sections joined together and having a hub therebetween, and rotatably supported in said housing;

2. said rollers being loosely supported by at least one of said flat sections and disposed therebetween for rotation about axes parallel to said axis and offset therefrom; and 3. a centrally apertured guide member freely rockably carried on said hub which hub extends into the aperture of said guide member, said guide member having a plurality of recesses disposed in uniform angular spacing about said axis and receiving said rollers at their tube-engaging peripheries.

3. A combined pump and siphon, comprising:

a. a housing;

b. a resilient tube disposed within said housing and having an inlet and an outlet, said tube having a portion intermediate its ends and extending in an arcuate manner;

c. a carrier supported for rotation about the axis of said arcuate portion within said housing and adapted to be driven from outside said housing, said carrier having a plurality of arcuate slots, each of which has both an angular and a radial extent whereby its radius with respect to said axis changes along its length;

d. a plurality of rollers supported in said slots by said carrier for being orbited thereby against said tube, said rollers being shiftable to the radially outer ends of said slots to collapse said tube in response to operational rotation of said carrier in one direction, and said rollers being shiftable to the radially inner ends of said slots in response to rotation of said carrier in the opposite direction to substantially disengage said tube; and e. a guide member supported on said carrier for free rocking movement through an angle of less than 180°, said guide member having radially projecting arms through which one of said rollers while under load from the tube acts to restrain the angular movement of another roller as said other roller disengages said tube during pumping movement.

4. A combined pump and siphon according to claim 3 in which said tube is U-shaped along its length about said axis, said tube having a radial cross-section, in its free state, which is circular throughout its length, said housing engaging and supporting the outside diameter of the U-shape, and a pair of fittings fixed in the ends of said tube and extending in a common direction away from said U-shape, said housing being composed of a pair of housing sections which meet in a plane passing through said fittings, said housing sections directly engaging and clamping said fittings against axial movement.

5. A pump according to claim 4, in which said fittings are further fixed by means of said housing sections detachably clamping said ends of said tube onto said fittings.

6. A combined pump and siphon according to claim 3 in which said tube is U-shaped along its length about said axis, said inlet and said outlet extending in one direction, and a handle formed integrally with said housing and having a gripping portion lying in a plane common to said inlet and said outlet and being spaced away from that portion of the housing which encloses the arcuate portion of said tube.

7. A combined pump and siphon, comprising:

a. a housing;

b. a resilient tube disposed within said housing and having an inlet and an outlet, said tube having a portion intermediate its ends and extending in an arcuate manner;

c. a plurality of rollers in said housing;

d. a carrier comprising a pair of separate co-rotatably joined complemental sections having congruent slots each of which as both an angular and a radial extent whereby its radius with respect to the axis of said arcuate portion changes along its length, and between which sections and in which slots said rollers are trapped and are rotatably and radially movable, said carrier being rotatably supported within said housing for rotation about the axis of said arcuate portion for orbiting said rollers thereagainst, the direction of radial movement of said rollers being automatically thereby dependent upon the direction of carrier rotation, and the magnitude of radial movement of said rollers being such as to collapse and to substantially disengage said arcuate portion of said tube.

8. A combined pump and siphon, comprising:

a. a housing;

b. a resilient tube disposed within said housing and having an inlet and an outlet, said tube having a portion intermediate its ends and extending in an arcuate manner;

c. a plurality of rollers in said housing;

d. support means within said housing supporting said rollers, said support means being rotatable about the axis of said arcuate portion for orbiting said rollers, said support means including means enabling said rollers to automatically shift radially to engage and collapse said tube in response to operational rotation of said support means in one direction, and to automatically shift said rollers radially to substantially disengage said tube in response to rotation of said support means in the other direction; and e. said housing having a pair of fixed axially spaced bearing portions integrally formed thereon, and said support means having complemental movable bearing portions integrally formed thereon and disposed between and in engagement with said fixed bearing portions by which said support means is rotatably supported.

9. A combined pump and siphon according to claim 8 further including a drive shaft extending through said fixed and movable bearing portions along said axis, said drive shaft having a non-circular external cross-section, and said movable bearing portions having a complemental non-circular internal cross-section by which there is provided a drive-fit with said support means.

10. A combined pump and siphon according to claim 8 including a crank having a drive portion receivable selectably through said housing along said axis from either one of both sides of said housing into driving relation with said support means within said movable bearing portions.

* * * * *